US008341784B2

(12) United States Patent
Scott et al.

(10) Patent No.: US 8,341,784 B2
(45) Date of Patent: Jan. 1, 2013

(54) APPARATUSES AND METHODS FOR AUTOMATIC PILLOW ADJUSTMENT

(75) Inventors: David B. Scott, Carthage, MO (US); Robert D. Oexman, Carthage, MO (US)

(73) Assignee: Kingsdown, Inc., Mebane, NC (US)

( * ) Notice: Subject to any disclaimer, the term of this patent is extended or adjusted under 35 U.S.C. 154(b) by 0 days.

(21) Appl. No.: 12/867,684

(22) PCT Filed: Feb. 13, 2009

(86) PCT No.: PCT/US2009/034077

§ 371 (c)(1),
(2), (4) Date: Aug. 13, 2010

(87) PCT Pub. No.: WO2009/102968

PCT Pub. Date: Aug. 20, 2009

(65) Prior Publication Data

US 2010/0313359 A1 Dec. 16, 2010

Related U.S. Application Data

(62) Division of application No. 61/028,572, filed on Feb. 14, 2008.

(51) Int. Cl.
*A47C 16/00* (2006.01)
*B68G 5/00* (2006.01)

(52) U.S. Cl. ..... 5/655.3; 5/636; 5/644; 5/645; 5/640

(58) Field of Classification Search ..... 5/655.3, 5/644, 636, 632, 713, 709, 706, 640, 645; 700/301, 108

See application file for complete search history.

(56) References Cited

U.S. PATENT DOCUMENTS

| | | | | |
|---|---|---|---|---|
| 4,501,034 | A * | 2/1985 | Greenawalt | 5/644 |
| 4,982,466 | A | 1/1991 | Higgins et al. | |
| 5,062,169 | A | 11/1991 | Kennedy et al. | |
| 5,105,488 | A | 4/1992 | Hutchinson et al. | |
| 5,231,717 | A | 8/1993 | Scott et al. | |
| 5,848,450 | A | 12/1998 | Oexman et al. | |
| 5,987,675 | A | 11/1999 | Kim | |
| 6,327,725 | B1 | 12/2001 | Veilleux et al. | |
| 6,457,192 | B2 | 10/2002 | Choi et al. | |
| 6,571,192 | B1 | 5/2003 | Hinshaw et al. | |
| 6,585,328 | B1 | 7/2003 | Oexman et al. | |
| 6,687,935 | B2 | 2/2004 | Reeder et al. | |
| 6,741,950 | B2 | 5/2004 | Hinshaw et al. | |
| 6,986,182 | B2 | 1/2006 | Mossbeck | |

(Continued)

OTHER PUBLICATIONS

Tilley, Alvin R., The Measure of Man and Woman, 2002, John Wiley & Sons, New York.

(Continued)

*Primary Examiner* — Robert G Santos
*Assistant Examiner* — Brittany Wilson
(74) *Attorney, Agent, or Firm* — Sughrue Mion, PLLC

(57) ABSTRACT

An adjustable head support apparatus includes an adjustable head support member including one or more inflatable members; and an encasement layer configured to encase the one or more inflatable members. The adjustable head support apparatus further includes a measurement unit configured to provide measurements relating to a pressure of the one or more inflatable members; an analysis unit configured to determine goal characteristics of the adjustable head support member for a person using the measurements relating to the pressure of the one or more inflatable members; and a control unit configured to control adjustments to pressure of the one or more inflatable members using the determined goal characteristics.

15 Claims, 5 Drawing Sheets

U.S. PATENT DOCUMENTS

| | | | | |
|---|---|---|---|---|
| 6,990,425 | B2 | 1/2006 | Hinshaw et al. | |
| 7,127,759 | B2 * | 10/2006 | Koops | 5/644 |
| RE41,809 | E | 10/2010 | Hinshaw et al. | |
| 2003/0125899 | A1 | 7/2003 | Hinshaw et al. | |
| 2004/0139549 | A1 | 7/2004 | Mohrekesh et al. | |
| 2004/0177449 | A1 | 9/2004 | Wong et al. | |
| 2004/0215416 | A1 | 10/2004 | Hinshaw et al. | |
| 2006/0179573 | A1 | 8/2006 | Nissen et al. | |
| 2007/0056112 | A1 * | 3/2007 | Graebe | 5/655.3 |
| 2007/0061974 | A1 * | 3/2007 | Gabbay | 5/632 |
| 2007/0061976 | A1 | 3/2007 | Bazargani | |
| 2007/0199154 | A1 | 8/2007 | Escaross | |
| 2009/0006027 | A1 | 1/2009 | Hinshaw | |
| 2009/0240514 | A1 | 9/2009 | Oexman et al. | |
| 2010/0317930 | A1 | 12/2010 | Oexman et al. | |
| 2010/0318239 | A1 | 12/2010 | Oexman et al. | |
| 2011/0010249 | A1 | 1/2011 | Oexman et al. | |

OTHER PUBLICATIONS

Diffrient, Niels et al., Humanscale 1/2/3, 1974, The MIT Press, Cambridge.

Diffrient, Niels et al., Humanscale 4/5/6, 1981, The MIT Press, Cambridge.

Dement, William C., "History of Sleep Physiology and Medicine," in Principles and Practice of Sleep Medicine, eds. Meir H. Kryger, Thomas Roth, and William C. Dement, 4th Edition, 2005, Elsevier Inc., Philadelphia.

Jacobson, Bert H. et al., "Subjective Rating of Perceived Back Pain, Stiffness and Sleep Quality Following Introduction of Medium-Firm Bedding Systems," Journal of Chiropractic Medicine, Winter 2006, pp. 128-134, vol. 5, No. 4, National University of Health Sciences.

* cited by examiner

APPARATUSES AND METHODS FOR AUTOMATIC PILLOW ADJUSTMENT

CROSS-REFERENCE TO RELATED PATENT APPLICATION

This application claims priority from U.S. Provisional Patent Application No. 61/028,572, filed on Feb. 14, 2008, in the U.S. Patent and Trademark Office, the disclosure of which is incorporated herein by reference in its entirety.

BACKGROUND

1. Technical Field

Apparatuses and methods consistent with the present invention relate to automatic pillow adjustment. In particular, these apparatuses and methods relate to automatically adjusting a pillow in accordance with a person's sleeping position and in accordance with the sleep surface on which the person is disposed.

2. Description of the Related Art

Pillows and other head supports are important components of a sleep system that can significantly affect a person's quality of sleep. Among other things, pillows can facilitate proper postural alignment of the pillow user. If the vertebrae of a person's spine are in neutral alignment while sleeping, then this will increase the person's comfort during sleep, improve overall sleep quality, and will also help to reduce neck and back strain. On the other hand, if the vertebrae of a person's spine are out of alignment while sleeping, this may reduce the person's sleep quality, cause muscle soreness and pain, and could aggravate neck and/or back problems. Therefore, a pillow that facilitates proper spinal alignment can greatly enhance a person's overall sleep experience and promote better sleep quality.

The optimal levels of head and neck support that are necessary for a person's pillow to provide the person with proper spinal alignment vary considerably according to the person's physical attributes and even vary over the course of a given night according to the person's sleeping position. Considering that the average person changes their body position roughly 60 times per night during their sleep, there is a long-standing need for a pillow which automatically adjusts the support characteristics provided by the pillow in accordance with a person's sleeping position.

Adjustable pillows are conventionally available that allow a person to adjust the pillow's firmness level and height level in various ways to achieve their desired support levels. For example, U.S. Pat. No. 6,327,725 to Veilleux et al. (hereinafter the '725 patent) discloses an orthopedic pillow having an airtight chamber for providing adjustable support to a user's neck. As disclosed in the '725 patent, the level of neck support provided by the pillow disclosed therein can be adjusted manually using a hand-operated pump.

However, such conventional adjustable pillows like that disclosed in the '725 patent have a number of disadvantages. Among other disadvantages, although such conventional adjustable pillows can be adjusted, such adjustments rely on the user to determine the ideal support characteristics of the pillow. And, the manual adjustments that a user makes based on what "feels" most comfortable to the user may not necessarily provide optimal support for proper spinal alignment. Thus, there is a need for an objective method for determining the optimal support characteristics for a pillow in accordance with the person's physical attributes.

Additionally, even if, hypothetically, the user were to somehow manually adjust the pillow disclosed in the '725 patent so that it provides ideal support characteristics for the user while the user is positioned in their typical sleeping position (e.g., on the user's back), the support characteristics of the pillow disclosed in the '725 patent nevertheless remain fixed throughout the night. Thus, even if the adjustable pillow in the '725 patent, in such a hypothetical situation, were adjusted to provide ideal support for the user while the user is positioned on their back (i.e. the user's typical sleeping position), the adjustable pillow in the '725 patent would not provide ideal support for the user when they are sleeping on their side or, for that matter, any other position besides their back.

Accordingly, there is also a need for an adjustable pillow that automatically adjusts so as to continuously provide the ideal support characteristics to a person as the person's body position changes during the course of a night.

While some automatically adjustable pillow systems have been developed, none of the conventional pillow systems have adequately addressed the aforementioned needs, and other needs not specifically mentioned above. For instance, U.S. Patent Publication No. 2004/0177449 to Wong et al. (hereinafter "the '449 publication"), provides an adjustable mattress and pillow system in which an electrically conductive sensing mat is positioned on a top face of a mattress. As disclosed in the '449 publication, the sensing mat is able to differentiate pressures or applied weight per unit area of a user's upper body in different poses.

However, the adjustable pillow system disclosed in the '449 publication has a number of shortcomings. Among other shortcomings, as disclosed in the '449 publication, a separate sensing mat 2 positioned on a top face 1A of the mattress is required in addition to the pillow 5 to detect pressures or applied weight per unit area of a user's upper body. Moreover, the pillow 5 disclosed in the '449 publication must be connected to a separate external apparatus, namely, the pillow 5 must be connected to the fluid reservoir 10 by conduits 7 and 9, through pumping/control unit 8, under control of control device 8A.

Thus, the adjustable pillow system disclosed in the '449 publication is inconvenient for a user in that it requires cumbersome connections to a large number of devices that are external to the pillow 5. Further, the adjustable pillow system disclosed in the '449 publication cannot easily be moved between mattresses since it must be connected to the sensing mat 2, which is disposed on a top face 1A of the mattress. The adjustable pillow system disclosed in the '449 publication also cannot be moved to different sleep surfaces such as a couch, a floor, an airplane seat, a car seat, etc., since the pillow 5 must maintain external connections to the sensing mat 2, the fluid reservoir 10, the pumping/control unit 8, and the control device 8A, in order to function properly.

Another conventional adjustable pillow disclosed in U.S. Patent Publication No. 2004/0139549 (hereinafter "the '549 publication") has similar disadvantages and others not discussed above. The adjustable pillow disclosed in the '549 publication uses an automatically adjustable chamber that changes the motion and height of the head support, either intermittently or continuously, throughout a person's sleep cycle so as to gently move the head of the user, which results in reduced neck pain or snoring, or both.

To achieve these features, the '549 publication discloses that one or more sensors 20 can be a pressure sensor, a vibration sensor and/or an acoustical sensor that can detect when a user is snoring and then activate the pump device 22 to begin the height adjustment of the head support 12. The '549 publication also discloses that the sensors 20 can sense when the user tosses and turns and institute a height adjustment until the user stops tossing and turning after a set period.

However, the system disclosed in the '549 publication merely oscillates the height of the head support portion 12 from a minimum height $H_{MIN}$ to a maximum height $H_{MAX}$. The '549 system does not adjust the pillow to the optimal support characteristics of the specific user. Further, the system disclosed in the '549 publication does not adjust according to the body position of the user. Rather, the '549 system only detects the presence of snoring or the presence of tossing and turning (i.e. the '549 system only detects movement not body position).

Moreover, much like the system disclosed in the '449 publication, the adjustable pillow of the '549 publication requires cumbersome external connections to a control device 16 and a reserve bladder 19. As shown in FIG. 1, for example, the aforementioned control device 16 and reserve bladder 19 are disposed external to the head support portion 12.

Accordingly, there is a need for a pillow that provides optimal support characteristics for a person in accordance with the person's physical attributes. Further, there is a need for a simple and convenient adjustable pillow system that can automatically adjust the attributes of the pillow to provide optimal support characteristics to the person in accordance with the person's body position. There is also a need for an automatically adjustable pillow system that does not require a connection to a sensing mat disposed on a top surface of the mattress and, further, for such a system that comprises a head support member having no external physical connections. Finally, there is a need for an automatically adjustable pillow system that is not attached to a particular mattress, that can be easily moved between different mattresses and, more generally, can be employed on any sleep surface including, but not limited to, a couch, a floor, an airplane seat, a car seat, etc.

SUMMARY

The present invention provides apparatuses and methods relating to automatic pillow adjustment.

According to an aspect of the present invention, an adjustable head support apparatus is provided comprising: an adjustable head support member comprising: a first inflatable member; a second inflatable member; and an encasement layer configured to encase the first inflatable member and the second inflatable member; a measurement unit configured to provide measurements relating to a first pressure of the first inflatable member and a second pressure of the second inflatable member; an analysis unit configured to determine goal characteristics of the adjustable head support member for a person using the measurements relating to the first pressure and the second pressure; and a control unit configured to control adjustments to pressure of the first inflatable member and to pressure of the second inflatable member using the determined goal characteristics.

According to an aspect of the present invention, an adjustable head support apparatus is provided comprising: an adjustable head support member comprising: an inflatable member; and an encasement layer configured to encase the inflatable member; a measurement unit configured to provide measurements relating to a pressure of the inflatable member; an analysis unit configured to determine goal characteristics of the adjustable head support member for a person using the measurements relating to the pressure; and a control unit configured to control adjustments to pressure of the inflatable member using the determined goal characteristics.

According to another aspect of the present invention there is provided a method for adjusting an adjustable head support member comprising: adjusting a first inflatable member until a pressure of the first inflatable member is a first predetermined level; adjusting a second inflatable member until a pressure of the second inflatable member is a second predetermined level; determining whether a force is applied to at least one of the first inflatable member and the second inflatable member by a person; if it is determined that the force is applied to at least one of the first inflatable member and the second inflatable member by a person then: acquiring measurement data relating to a first pressure of the first inflatable member; acquiring measurement data relating to a second pressure of the second inflatable member; calculating a difference between the first predetermined level and the first pressure; calculating a difference between the second predetermined level and the second pressure; determining a first goal pressure of the first inflatable member; determining a second goal pressure of the second inflatable member; adjusting the first inflatable member to the first goal pressure; and adjusting the second inflatable member to the second goal pressure.

According to another aspect of the present invention there is provided a method for adjusting an adjustable head support member comprising: adjusting an inflatable member until a pressure of the inflatable member is a first predetermined level; determining whether a force is applied to the inflatable member by a person; if it is determined that the force is applied to the inflatable member by a person then: acquiring measurement data relating to a first pressure of the inflatable member; calculating a difference between the first predetermined level and the first pressure; determining a first goal pressure of the inflatable member; and adjusting the inflatable member to the first goal pressure.

According to another aspect of the present invention, an adjustable head support member for a person is provided comprising: a first inflatable member; a second inflatable member; an encasement layer configured to encase the first inflatable member and the second inflatable member; a first regulator valve configured such that, if a first pressure within the first inflatable member exceeds a first value, then the first regulator valve operates to reduce pressure within the first inflatable member; and a second regulator valve configured such that, if a second pressure within the second inflatable member exceeds a second value, then the second regulator valve operates to reduce pressure within the second inflatable member; wherein the first value and the second value are determined using the person's physical characteristics.

According to another aspect of the present invention, an adjustable head support member for a person is provided comprising: an inflatable member; an encasement layer configured to encase the inflatable member; and a first regulator valve configured such that, if a first pressure within the inflatable member exceeds a first value, then the first regulator valve operates to reduce pressure within the inflatable member; wherein the first value is determined using the person's physical characteristics.

BRIEF DESCRIPTION OF THE DRAWINGS

The above and other aspects of the present invention will become more apparent by describing in detail illustrative embodiments thereof with reference to the attached drawings in which.

DETAILED DESCRIPTION OF ILLUSTRATIVE EMBODIMENTS

Figure 1:
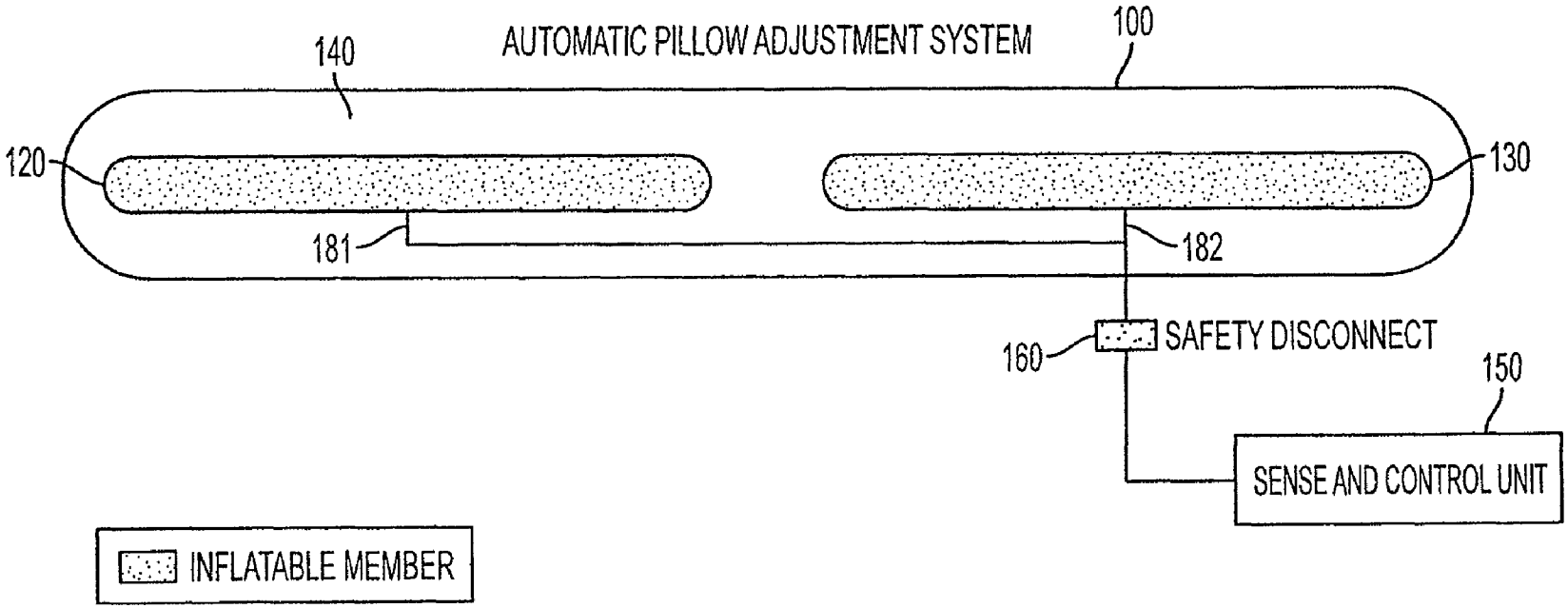
FIG. 1 illustrates a schematic cross-sectional view of an automatic pillow adjustment system according to an illustrative embodiment of the present invention.

Illustrative embodiments of the invention will now be described in detail with reference to the attached drawings in which like reference numerals refer to like elements.

FIG. 1 illustrates a schematic cross-sectional view of an automatic pillow adjustment system according to an illustrative embodiment of the present invention. As shown in FIG. 1, an adjustable head support member 100 comprises a first inflatable member or bladder 120 and a second inflatable member 130. However, the present invention is not limited to the illustrative embodiment shown in FIG. 1, and only one inflatable member or any number of inflatable members may be employed consistent with the present invention. As shown in FIG. 1, an encasement layer 140 surrounds both the first inflatable member 120 and the second inflatable member 130. According to one illustrative embodiment, the encasement layer 140 comprises conventional pillow filler materials including, but not limited to, feathers, down, synthetic fibers, foam, etc. The encasement layer (among other things) supports weight of the portions of a person's body that are disposed on the adjustable head support member 100.

The illustrative embodiment shown in FIG. 1 comprises two inflatable members 120 and 130 positioned side by side. However, the present invention is not limited to this specific configuration and one inflatable member or any number of inflatable members may be employed within the adjustable head support member 100, in any arrangement, consistent with the present invention.

Figure 2:
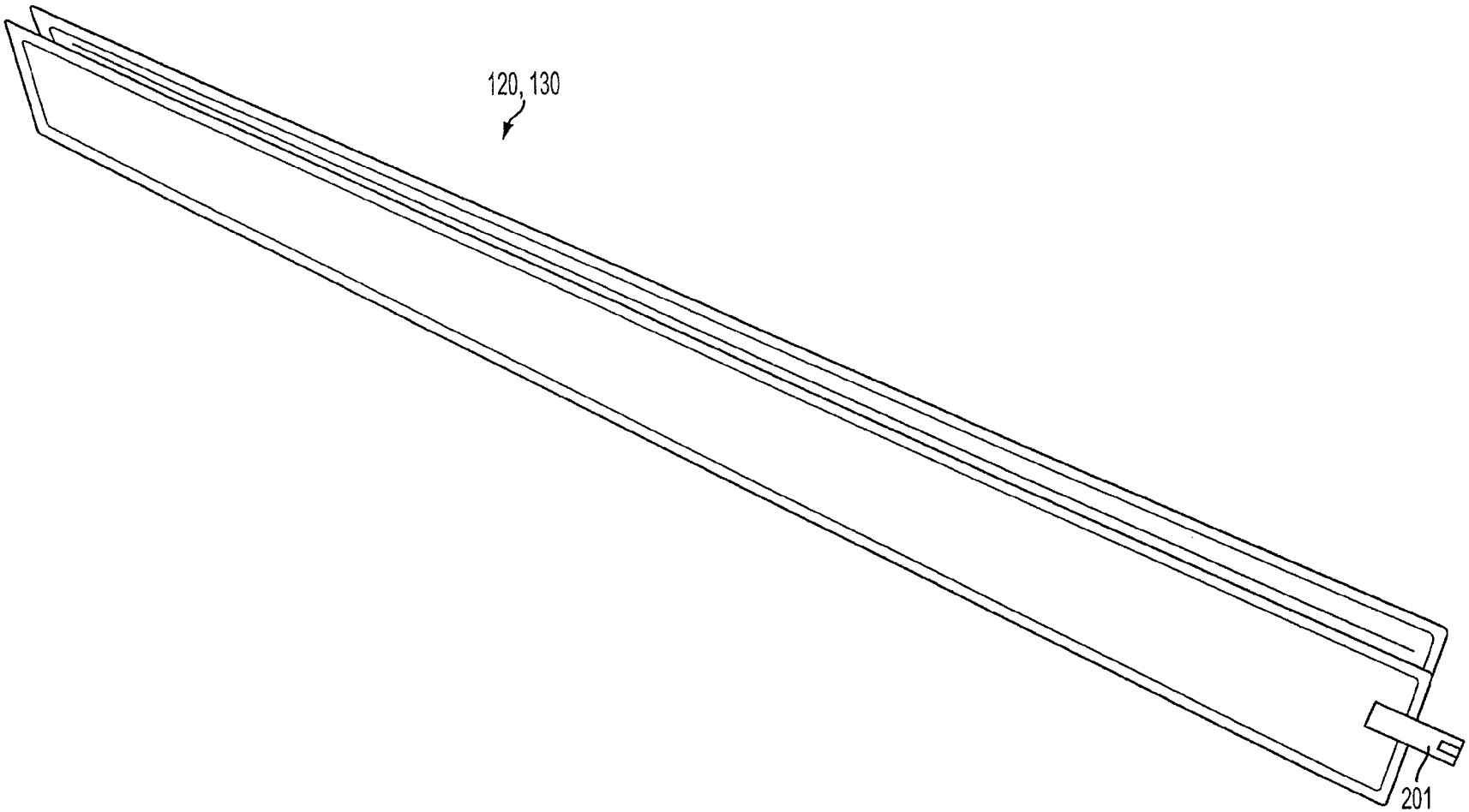
FIG. 2 illustrates an inflatable member according to an illustrative embodiment of the present invention.

FIG. 2 illustrates a view of an inflatable member 120 or 130 according to an illustrative embodiment of the present invention. Although one illustrative shape and configuration of the inflatable member is shown in FIG. 2, the inflatable members 120 and 130 may assume other shapes and configurations consistent with the present invention. As shown in FIG. 2, each of the inflatable members 120 and 130 comprises a valve 201.

According to the illustrative embodiment shown in FIG. 1, the inflatable members 120 and 130 are pneumatic and are connected to a sense and control unit 150. However, the present invention is not limited to this illustrative configuration and other gasses or fluids besides air may be used to inflate/deflate the inflatable members 120 and 130 to a desired pressure. The inflatable members 120 and 130 may be constructed of a variety of materials including, but not limited to plastic, vinyl, neoprene, rubber and the like.

As shown in FIG. 1, a safety disconnect unit 160 may be disposed between the inflatable members 120 and 130 and the sense and control unit 150. According to an illustrative embodiment, the safety disconnect unit 160 is configured to disconnect the inflatable members 120 and 130 from the sense and control unit 150 when a person applies a force to the safety disconnect unit 160.

According to the illustrative embodiment shown in FIG. 1, the inflatable members 120 and 130 extend in a lateral direction across the width of the adjustable head support member 100. Further, as shown in FIG. 1, the inflatable members 120 and 130 are configured such that, when inflated, the inflatable members 120 and 130 expand and thereby apply forces to the encasement layer 140, which (among other things) supports the weight of the head and neck region of a person's body. Accordingly, by controlling the inflation/deflation of the inflatable members 120 and 130, the support characteristics of the adjustable head support member 100 can be adjusted.

For instance, the inflation/deflation of the inflatable members 120 and 130 can be controlled to change the support level of the adjustable head support member 100 by making the encasement layer 140 either firmer or softer. That is, inflating or deflating a respective one of the inflatable members 120 and 130 has the effect of compressing or decompressing the encasement layer 140 above and below the respective inflatable member and thereby creates a different support profile for the user of the adjustable head support member 100. According to an illustrative embodiment, each of the inflatable members 120 and 130 can be controlled independently so as to independently adjust the support characteristics of different portions of the adjustable head support member 100.

Figure 4:
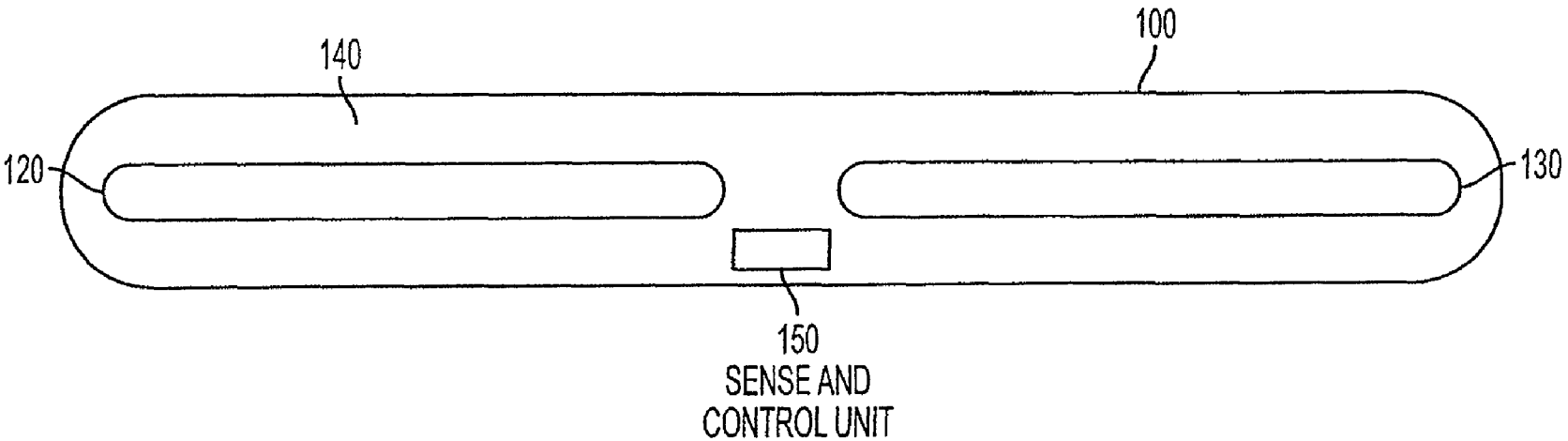
FIG. 4 illustrates a schematic cross-sectional view of an automatic pillow adjustment system according to an illustrative embodiment of the present invention.

Further, as shown in FIG. 1, the sense and control unit 150 is disposed external to the adjustable head support member 100 and the inflatable members 120 and 130 are connected to the sense and control unit 150 by pneumatic tubes 181 and 182. However, the present invention is not limited to this specific configuration. For instance, as shown in FIG. 4, the sense and control unit 150 can be disposed within the adjustable head support member 100 such that there are no external physical connections to/from the adjustable head support member 100.

Figure 3:
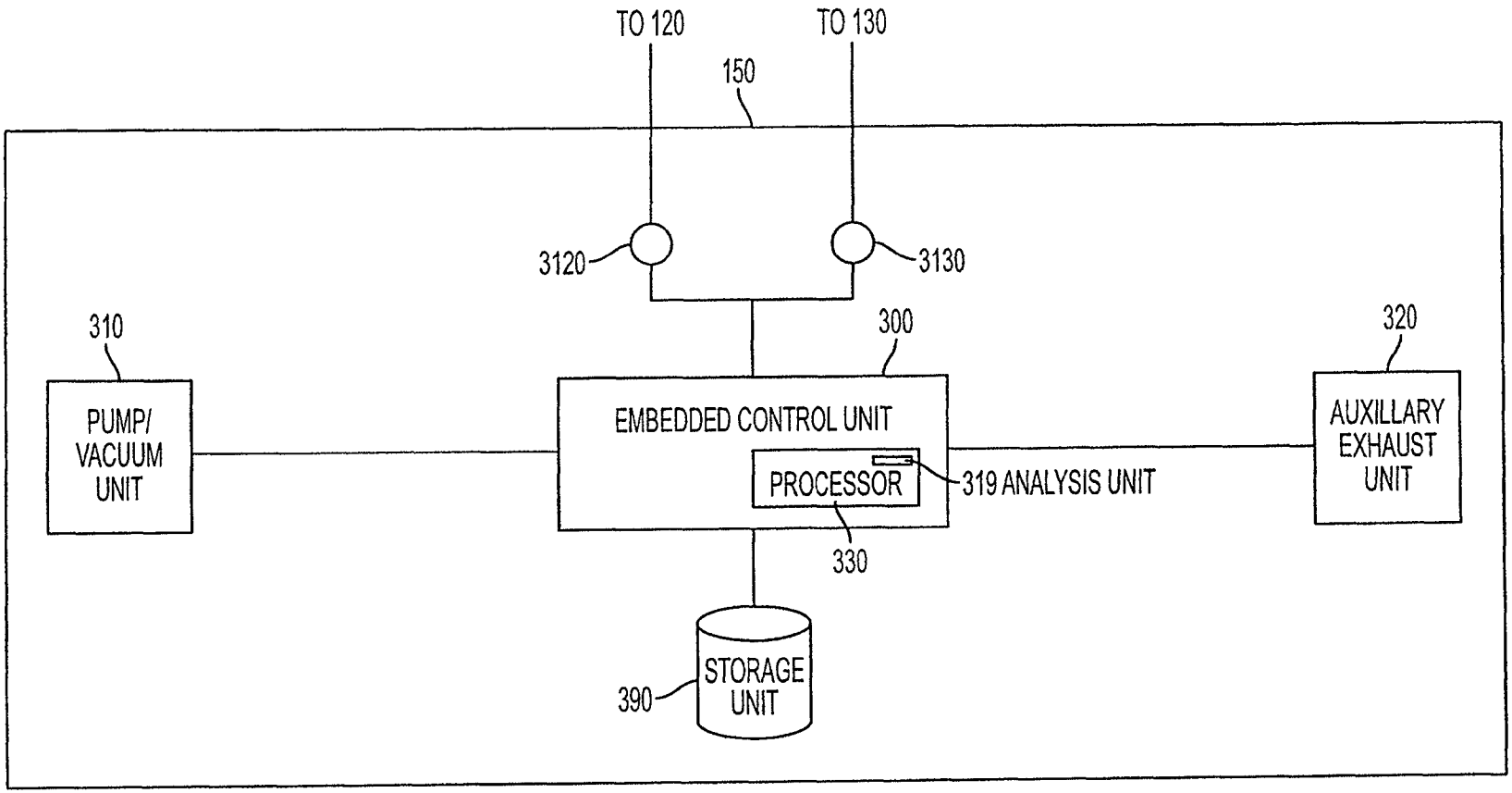
FIG. 3 illustrates a schematic diagram of a sense and control unit according to an illustrative embodiment of the present invention.

FIG. 3 illustrates a schematic diagram of a sense and control unit 150 according to an illustrative embodiment of the present invention. As shown in FIG. 3, the sense and control unit 150 comprises an embedded control unit 300, a pump/vacuum unit 310, an auxiliary exhaust unit 320 and a storage unit 390. The embedded control unit 300 further comprises a processor 330, which in turn comprises an analysis unit 319. The pump/vacuum unit 310 may be controlled by the embedded control unit 300 to pump or suck air to/from the inflatable members 120 and 130. The auxiliary exhaust unit 320 actively or passively exhausts gas or fluid from the inflatable members 120 and 130.

As shown in FIG. 3, the illustrative sense and control unit 150 comprises a first sensor 3120, which is connected to inflatable member 120, and a second sensor 3130, which is connected to inflatable member 130. However, the present invention is not limited to the specific configuration shown in FIG. 3 and any number of sensors/measurement units can be employed consistent with the present invention. According to an illustrative embodiment, each sensor may be grouped with a plurality of inflatable members.

Each of the sensors 3120 and 3130 is configured to provide real time measurements relating to the pressure of a respective inflatable member or a respective group of inflatable members. According to the illustrative embodiment shown in FIG. 3, the sensor 3120 provides real time measurements relating to the pressure of inflatable member 120 and, likewise, the sensor 3130 provides real time measurements relating to the pressure of inflatable member 130. As such, when a person positions their head on the adjustable head support member 100, measurements relating to the pressure of respective inflatable members 120 and 130 can be acquired and analyzed. Using such measurements, a support pressure profile of the person can be obtained and used to determine the most suitable pillow support characteristics for the person.

Consistent with the present invention, the sensors 3120 and 3130, together with the inflatable members 120 and 130, provide the ability to measure a wide variety of data. For example, when a person is positioned with their head on the adjustable head support member 100, data provided by the sensors 3120 and 3130 can be analyzed to determine, among other things, the sleeping position of the user.

For example, if a person is positioned with their head on the adjustable head support member 100, then the sensors 3120 and 3130 will measure greater pressures of the inflatable members 120 and 130 than if a person's head were not positioned on the adjustable head support member 100. Similarly, if a person is positioned with their head on the adjustable head support member 100 while lying on their back in a supine position facing upward, then the sensors 3120 and 3130 will measure greater pressures of the inflatable members 120 and 130 than if the person were lying on their side.

Accordingly, by analyzing the data collected by the sensors 3120 and 3130, the processor 330 can determine the sleeping position of the person (e.g., back, stomach, side, etc.) and can control the pressures of the inflatable members 120 and 130 so that the adjustable head support member 100 provides the optimal support characteristics for the person. For instance, when the person is lying on their back, a substantial amount of pressure will be applied by the person's head to the adjustable head support member 100. Thus, using data collected by the sensors 3120 and 3130, the processor 330 determines that the person is positioned on their back and controls the pressures of the inflatable members 120 and 130 to further deflate so that the adjustable head support member 100 provides proper neutral spinal alignment to the person.

Conversely, when the person is lying on their side, less pressure will be applied by the person's head to the adjustable head support member 100. Thus, using data collected by the sensors 3120 and 3130, the processor 330 determines that the person is positioned on their side and controls the pressures of the inflatable members 120 and 130 to further inflate so that the adjustable head support member 100 provides proper neutral spinal alignment to the person.

According to an illustrative embodiment of the present invention, the data provided by the sensors 3120 and 3130 can also be analyzed to determine movement by the user, which can then be interpreted into data relating to the user's quality of sleep.

According to an illustrative embodiment of the present invention, the processor 330 can also use data collected by the sensors 3120 and 3130 to determine characteristics of the sleep surface on which the adjustable head support member 100 is disposed and adjust the pressures of the inflatable members 120 and 130 accordingly. For instance, when a person is lying on a firm mattress, the sensors 3120 and 3130 will measure greater pressures of the inflatable members 120 and 130 than if the person were lying on a soft mattress.

Consistent with the present invention, the inflation/deflation adjustments discussed above can be performed gradually so that such adjustments to not wake the person. Further, the pump/vacuum unit 310 can be configured as an ultra quiet pump/vacuum unit, which is barely audible during operation, so that such inflation/deflation adjustments do not disturb the person's sleep.

Consistent with the present invention, the optimal pressure levels for each of the respective inflatable members 120 and 130 and at which the adjustable head support member 100 provides optimal support characteristics to the person can be determined in a number of ways. For example, such optimal pressure levels can be determined by analyzing data obtained by observing a plurality of different persons of varying physical attributes (e.g., persons of different heights, weights, weight distributions, waist widths, shoulder widths, etc.) as they are positioned on a variety of different pillow systems and sleep systems having different support characteristics, in a variety of different sleeping positions, and by recording observed data in the storage unit 390. By recording such observed data in the storage unit 390, along with which particular pillow support characteristics provide each respective person with the best support (e.g., spinal alignment, etc.) a correspondence between particular physical attributes of persons and suitable support characteristics for the person's pillow/sleep system can be established and stored in the storage unit 390.

Examples of apparatuses and methods for objectively evaluating a person on a sleep system so as to determine the optimal comfort and support characteristics for the person have been developed by the inventors of the present application, as set forth in a related Provisional Application entitled "Apparatus and Methods for Evaluating a Person on a Sleep System," U.S. Provisional Application No. 61/028,578, which is incorporated herein by reference in its entirety. However, such apparatuses and examples are merely illustrative and the present invention is not limited to these examples. The apparatuses and methods disclosed in U.S. Provisional Application No. 61/028,578 can be employed to (among other things) recommend which of the generic pillow systems that are commercially available will most closely provide the person with the optimal support characteristics that are determined for the person in accordance with their individual characteristics.

According to an illustrative embodiment, the apparatuses and methods disclosed in U.S. Provisional Application No. 61/028,578 can also be employed to recommend adjustment settings for an automatically adjustable pillow in accordance with the present invention. That is, the optimal pressure levels of the inflatable members 120 and 130 for a person can be calculated as set forth in U.S. Provisional Application No. 61/028,578 using the test bed disclosed therein. Such calculations can then be used to provide the most suitable support settings to which the adjustable head support member 100 can be adjusted. For example, the calculations from the aforementioned test bed can be provided to and stored in a storage unit 390 (shown in FIG. 3) in a variety of ways including, but not limited to, transfer via wireless or wired communication, transfer via storage media, manual data input, etc.

That is, by way of illustration, a prospective pillow system purchaser could visit a showroom where an evaluation of the person on a sleep system can be performed according to U.S. Provisional Application No. 61/028,578. As a result of this evaluation, the prospective sleep system purchaser would be provided with optimal adjustable pillow support settings to be transferred to an adjustable head support member 100 in the purchaser's home. Thus, the adjustable head support member 100 would adjust the inflatable members 120 and 130 to the optimal pressure levels so as to provide the optimal support characteristics to the purchaser.

Figure 5:
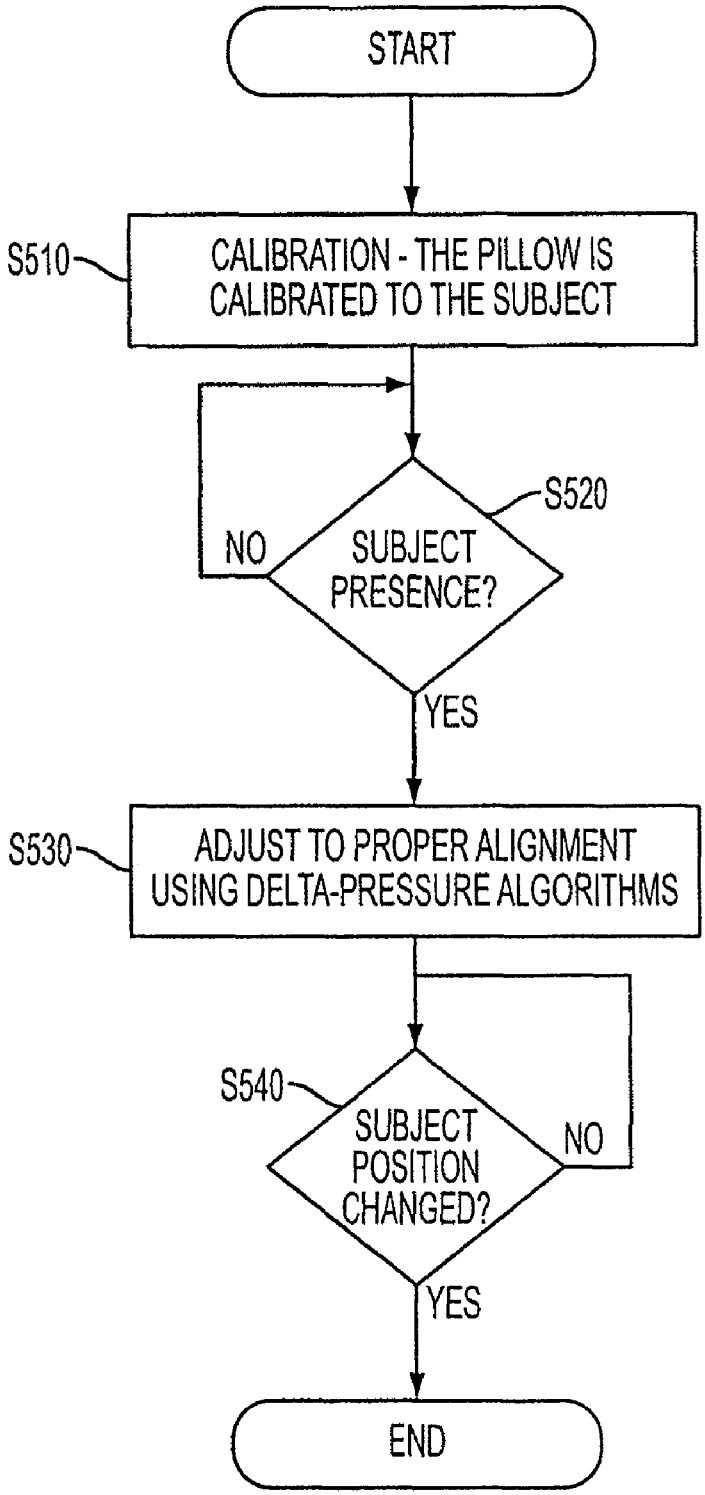
FIG. 5 illustrates a flow chart for a method of automatic pillow adjustment according to an illustrative embodiment of the present invention.

FIG. 5 illustrates a flow chart for a method of automatic pillow adjustment according to an illustrative embodiment of the present invention. As shown in FIG. 5, in operation S510, the sense and control unit 150 first initiates a calibration mode by inflating/deflating each of the respective inflatable members 120 and 130 until the pressures of each of the inflatable members 120 and 130 are set to a predetermined state.

In operation S520, the sense and control unit 150 then determines whether or not the subject is present. That is, the sense and control unit 150 determines whether or not the subject is causing any forces to be applied to the inflatable members 120 and 130 by, for example, resting their head on the adjustable head support member 100. If the subject is not present, then operation S520 is repeated until the sense and control unit 150 determines that the subject is present.

If, in operation S520, the sense and control unit 150 determines that the subject is present, then in operation S530, the sense and control unit 150 acquires measurement data from each of the sensors 3120 and 3130. Among other things, the processor 330 calculates a change in pressure ($\Delta_{Pressure}$) for each of the respective sensors 3120 and 3130. By applying various algorithms to the calculated change in pressure ($\Delta_{Pressure}$), the processor 330 can determine a variety of useful analytical measurements of the subject. The processor 330 can then use these analytical measurements to determine the best combinations of zoned support provided by the adjustable head support member 100 that is needed to produce a healthy sleep system, considering (among other things) the subject's resting position. Accordingly, in operation S530, the optimal pressure levels for each of the respective inflatable members 120 and 130 at which the adjustable head support member 100 provides optimal support characteristics to the subject are calculated using various $\Delta_{Pressure}$ algorithms. Further, the sense and control unit 150 adjusts each of the respective inflatable members 120 and 130 to the calculated optimal pressure levels so that the adjustable head support member 100 provides optimal support characteristics to the subject.

Next, in operation S540, the sense and control unit 150 determines whether or not the subject's position has changed. If the subject's position has not changed, then operation S540 is repeated until the sense and control unit 150 determines that the subject's resting position has changed. If the sense and control unit 150 determines that the subject's resting position has changed, then operation S520 is performed.

In addition to the support characteristics of the adjustable head support member 100 being automatically adjustable, as described above, a person could also manually control the support characteristics of the adjustable head support member 100 based on support levels that the person selects. For example, if a person desired to make the adjustable head support member 100 feel firmer under the person's neck region, then the person could control the inflatable member(s) 120 and/or 130 corresponding to the person's neck region to be further inflated by increasing the pressure of the respective inflatable member(s) 120 and/or 130. When the respective inflatable member(s) 120 and/or 130 corresponding to the person's neck region inflate and expand, the respective inflatable member(s) 120 and/or 130 cause the regions of the encasement layer 140 above and below to compress. Consequently, the adjustable head support member 100 applies greater support to the region corresponding to the person's neck.

Conversely, if the person desired to make the adjustable head support member 100 provide less support, then the person could control the sense and control unit 150 to reduce the pressure of certain inflatable member(s) 120 and 130 (e.g., by releasing air from certain inflatable member(s) 120 and 130) so as to cause the adjustable head support member 100 to apply less support to the person in those areas.

Since the adjustable head support member 100 can be configured without any external connections, a person can easily move the adjustable head support member 100 from one sleep surface to another, regardless of whether the sleep surface is another mattress, the floor, an airplane seat, a car seat, etc.

Consistent with an illustrative embodiment of the present invention, the adjustable head support member 100 described above can be used in conjunction with the variable sleep system disclosed by the inventors of the present application in a related Provisional application entitled, "Apparatuses and Methods Providing Variable Support and Variable Comfort Control of a Sleep System and Automatic Adjustment Thereof," U.S. Provisional Application No. 61/028,591, which is incorporated herein by reference in its entirety. Indeed, the variable sleep system disclosed in U.S. Provisional Application No. 61/028,591 analyzes data provided by support layer sensors and comfort layer sensors to determine, among other things, the person's weight, weight distribution, body position, breathing rate, heart rate, state of sleep, etc. Further, such data can be acquired and analyzed over time to determine a variety of body variances of the person while the person sleeps. Thus, the adjustable head support member 100 can be configured to connect with the variable sleep system disclosed in U.S. Provisional Application No. 61/028,591 via any conventional wired or wireless methods and can be adjusted, along with the variable sleep system, in accordance with the body variances of the user.

While the illustrative embodiments described above comprise a sense and control unit 150, the present invention is not limited to this specific configuration. To the contrary, the adjustable head support member 100 can comprise a passive system wherein the pressure within the inflatable members 120 and 130 is adjusted via regulator valves. Accordingly, air can be moved from one inflatable member 120 to the other inflatable member 130 without any electronic devices at all. In particular, such regulator valves operate in accordance with the pressure within the respective inflatable member 120 or 130. When the pressure applied to the regulator valve by the air in the respective inflatable member 120 or 130 exceeds a certain value, then the regulator valve opens to allow air to filter from within the respective inflatable member to the other inflatable member and, once the pressure is equalized, the regulator valve will close.

According to one illustrative embodiment, optimal pressure levels for each of the respective inflatable members 120 and 130 at which the adjustable head support member 100 provides optimal support characteristics to a particular person are calculated using anthropometric data and measurements of the particular bed to be used by the person so as to achieve the desired pillow characteristics. Examples of such anthropometric data are provided by the publications "Humanscale 1/2/3" by Niels Diffrient et al., MIT Press, copyright 1974, "Humanscale 4/5/6" by Niels Diffrient et al., MIT Press, copyright 1981, "The Measure of Man & Woman," Revised Edition, Alvin R. Tilley, John Wiley & Sons, Inc., copyright 2002, which are incorporated herein by reference in their entirety.

While the present invention has been particularly shown and described with reference to illustrative embodiments thereof, it will be understood by those of ordinary skill in the art that various changes in form and details may be made therein without departing from the spirit and scope of the invention as defined by the appended claims. The illustrative embodiments should be considered in a descriptive sense only and not for purposes of limitation. Therefore, the scope of the invention is defined not by the detailed description of the invention but by the claims set forth in the related non-provisional application and all differences within the scope will be construed as being included in the present invention.

What is claimed is:

1. An adjustable head support apparatus comprising:

an adjustable head support member comprising:

a first inflatable member;

a second inflatable member; and an encasement layer configured to encase the first inflatable member and the second inflatable member;

a measurement unit configured to provide measurements relating to a first pressure of the first inflatable member and a second pressure of the second inflatable member;

an analysis unit configured to determine objective goal values for the first pressure and the second pressure that provide neutral spinal alignment for a person positioned on the adjustable head support member, the goal values being objectively determined from anthropometric data derived from a plurality of different test persons; and a control unit configured to compare the measurements relating to the first pressure and the second pressure to the objective goal values for the first pressure and the second pressure and to automatically control adjustments to pressure of the first inflatable member and to pressure of the second inflatable member, the adjustments being designed to achieve the determined objective goal values, wherein the analysis unit is configured to determine whether the person is in a supine position, prostrate position or side-lying position, using the measurements relating to the first pressure and the second pressure.

2. The adjustable head support apparatus according to claim 1 further comprising a safety disconnect unit configured to disconnect the first inflatable member and the second inflatable member from the control unit if a force is applied to the safety disconnect unit.

3. The adjustable head support apparatus according to claim 1, wherein the control unit is disposed external to the adjustable head support member.

4. The adjustable head support apparatus according to claim 1, wherein the control unit is disposed within the adjustable head support member.

5. The adjustable head support apparatus according to claim 1, wherein the control unit comprises a pump/vacuum unit configured to inflate/deflate the first inflatable member and the second inflatable member.

6. The adjustable head support apparatus according to claim 1, wherein the control unit comprises a storage unit.

7. The adjustable head support apparatus according to claim 6, wherein the storage unit stores data relating to a plurality of different persons of varying physical attributes.

8. The adjustable head support apparatus according to claim 7, wherein the storage unit stores data relating to a plurality of different respective objective goal values for the first pressure and the second pressure for each of the plurality of different persons.

9. The adjustable head support apparatus according to claim 6, wherein the storage unit stores data relating to physical attributes of persons and corresponding values for the first pressure and the second pressure suitable for the respective physical attributes.

10. The adjustable head support apparatus according to claim 1, wherein the goal values for the first pressure and the second pressure provide neutral spinal alignment for the person in the supine position, prostrate position and side-lying position, respectively.

11. The adjustable head support apparatus according to claim 1, wherein the measurement unit is configured to provide periodic measurements relating to pressures of the first inflatable member and pressures of the second inflatable member over a period of time during which the person's head is positioned on the adjustable head support member;

wherein the analysis unit is configured to periodically determine objective goal values for the first pressure and the second pressure, which correspond to the periodic measurements; and wherein the control unit is configured to periodically control adjustments to pressure of the first inflatable member and pressure of the second inflatable member using the periodically determined objective goal values for the first pressure and the second pressure.

12. The adjustable head support apparatus according to claim 1, wherein the analysis unit is configured to determine characteristics of a sleep surface on which the adjustable head support member is disposed; and wherein the control unit is configured to control adjustments to pressure of the first inflatable member and to pressure of the second inflatable member using the determined characteristics of the sleep surface.

13. The adjustable head support apparatus according to claim 1, wherein the adjustable head support member is configured such that the first pressure and the second pressure can be manually adjusted according to subjective preferences of the person.

14. The adjustable head support apparatus according to claim 1, wherein the adjustable head support member is configured without external connections.

15. The adjustable head support apparatus according to claim 1, wherein the first inflatable member and the second inflatable member are configured such that pressures of the first inflatable member and the second inflatable member, respectively, are passively adjustable via regulator valves.

* * * * *